US012752146B2

(12) United States Patent
Weber

(10) Patent No.: US 12,752,146 B2
(45) Date of Patent: Oct. 6, 2026

(54) EXPANDER WITH DEGRESSIVE STRESS BEHAVIOUR

(71) Applicant: Yannik Weber, Berlin (DE)

(72) Inventor: Yannik Weber, Berlin (DE)

(73) Assignee: FUERALLEX LLC, Parrish, FL (US)

( * ) Notice: Subject to any disclaimer, the term of this patent is extended or adjusted under 35 U.S.C. 154(b) by 370 days.

(21) Appl. No.: 18/702,792

(22) PCT Filed: Mar. 4, 2022

(86) PCT No.: PCT/IB2022/051923
§ 371 (c)(1),
(2) Date: Apr. 18, 2024

(87) PCT Pub. No.: WO2022/185268
PCT Pub. Date: Sep. 9, 2022

(65) Prior Publication Data

US 2025/0065177 A1 Feb. 27, 2025

(30) Foreign Application Priority Data

Mar. 5, 2021 (DE) ..... 10 2021 105 410.9

(51) Int. Cl.
*A63B 21/055* (2006.01)
*A63B 21/04* (2006.01)

(52) U.S. Cl.
CPC ..... *A63B 21/0555* (2013.01); *A63B 21/04* (2013.01)

(58) Field of Classification Search
CPC ..... A63B 21/0552; A63B 21/0555; A63B 21/0557
See application file for complete search history.

(56) References Cited

U.S. PATENT DOCUMENTS 7,695,413 B1 * 4/2010 Cruz ..... A63B 21/04 482/126

FOREIGN PATENT DOCUMENTS

WO WO-2014158588 A1 * 10/2014 ..... A63B 21/4023

* cited by examiner

*Primary Examiner* — Zachary T Moore
(74) *Attorney, Agent, or Firm* — Older and Lundy LLC; Thomas Stanton; Eric Kleinertz

(57) ABSTRACT

An expander for training muscles, especially fast-acting muscle fibers, having an elastic element that can expand against its restoring force for the purpose of training, as well as a method for manufacturing such an expander. The elastic element consists of a composite of at least two different elastic materials, with a first elastic material being instantiated as a closed line pattern with an offset or non-offset four-fold or with a sixfold unit cell, with the closed line pattern being instantiated as boundary lines of the tiles of a tiling pattern, and with another elastic material filling out the surfaces of the tiles. The structure of the elastic element results in stress-strain diagrams with different gradients in different extension sections that are flatter in the working range and can be used advantageously for training explosive strength and speed.

10 Claims, 7 Drawing Sheets

Figure 1:
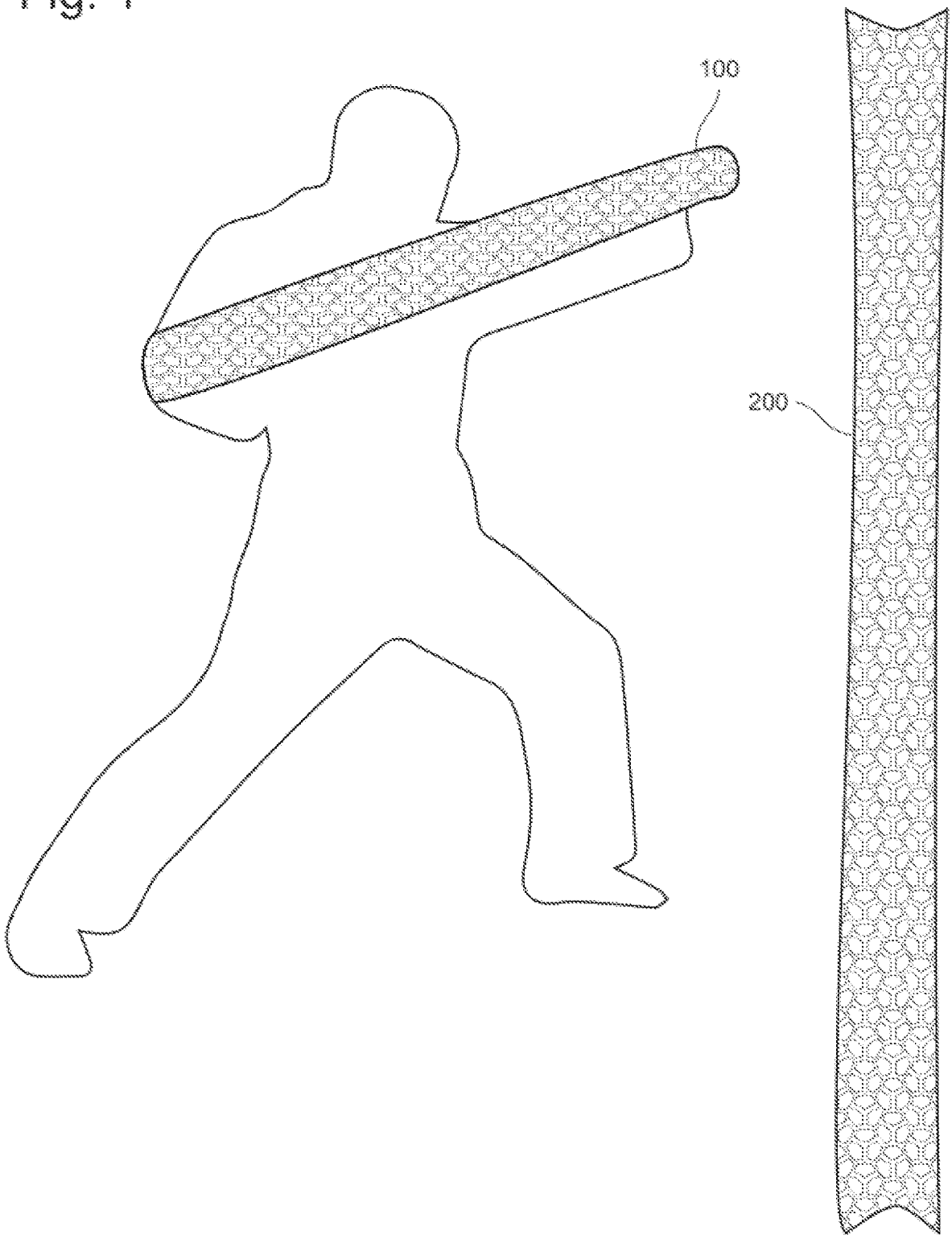

Fig. 7.1
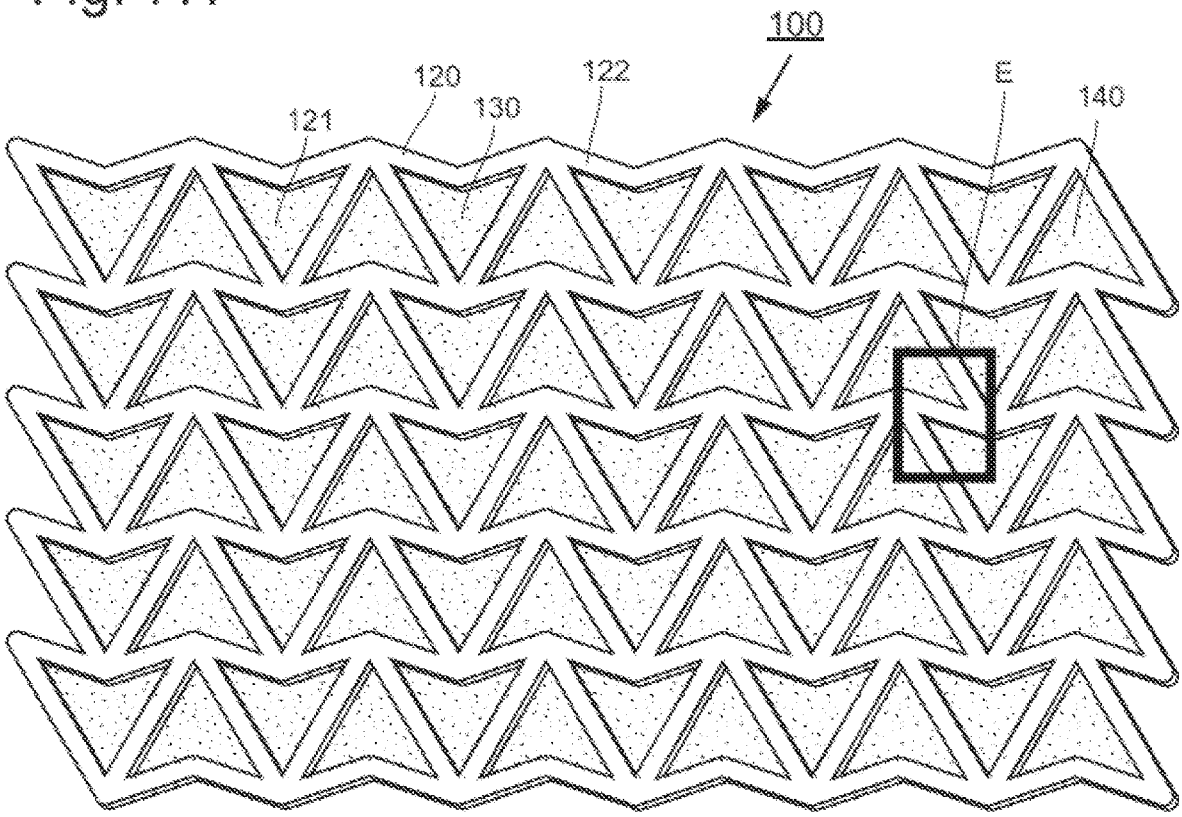
Fig. 7.2
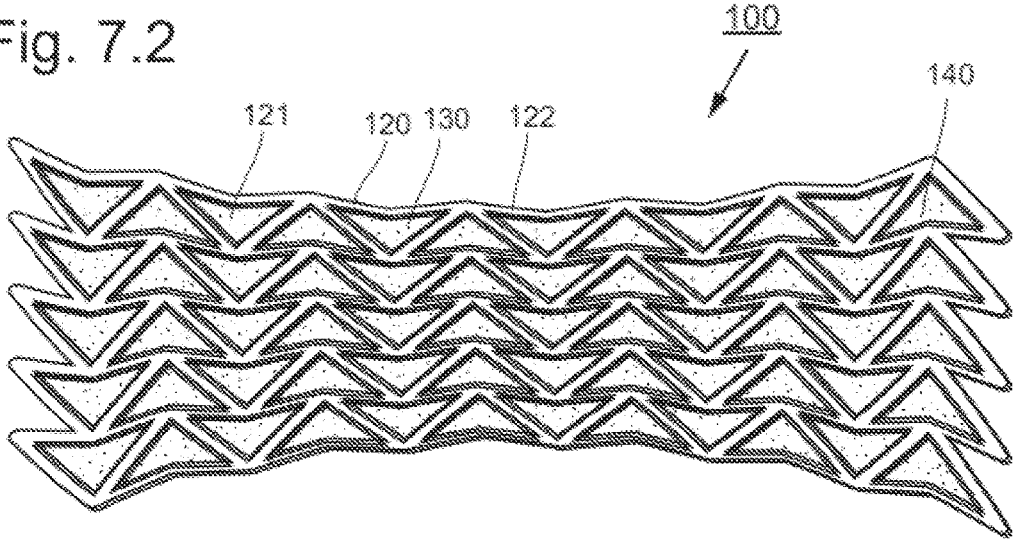

EXPANDER WITH DEGRESSIVE STRESS BEHAVIOUR

The invention relates to an expander for training the muscles having an elastic element that can be expanded against its restoring force for the purpose of training, as well as to a method for manufacturing such an expander.

Expanders are well known as training devices for strengthening the muscles. Some typical types of expander consist of handles that are connected by elastic rubber bands and can be pulled apart through appropriate exercises. Other expanders consist of an elongated latex sheet in the form of a band. The latex cloth is available as an open band or as a closed band ring. A typical exercise with a latex ring is to wrap the latex sheet around the body and to perform an extending movement with the limbs against the restoring force of the latex sheet.

The drawback of expanders of the existing type is that the restoring force is linear in the elastic range of linear expansion. When an extending movement is performed with the leg or arm, the arm or leg opens by extending the joint. When the arm is flexed, the necessary exertion for the corresponding extensor muscle is comparatively high, since the angle of attack for the muscle is very unfavorable for an extending movement due to the position of the joint.

Another drawback of a restoring force factor that is linear in the working range is that it is less suitable for training fast muscle movements. In order to train for fast extending movements such as those which are common for a boxer or fundamental in martial arts and in Olympic disciplines such as javelin throwing, it would be desirable if the restoring force along the muscle movement remained relatively constant as early as possible and for as long as possible. One typical exercise is to wrap an elastic band around the hips with the arms placed inside the elastic band. The trainee then performs sudden extending movements of the arms. Near the waist, the restoring force is desirably linear at first. However, it would be desirable for successful training of rapid muscle contraction if the extending arm could stretch in a boxing movement close to the extended arm against a constant force, or at least against a force that is no longer increasing in such pronounced fashion.

Generating a constant restoring force with an isotropic elastic material does not seem possible. This would be at odds with that familiar law discovered by and named after Robert Hooke. As a rule, elastic materials exhibit a range of elasticity with an approximately constant elastic modulus, with the force for linear expansion being proportional to the linear expansion itself. Near the end of the elastic range, the elastic modulus increases, which means that the increase in the restoring force intensifies with increasing linear expansion. Training for fast and powerful muscle movements in which as much force as possible is transformed into movement speed, thus enabling higher final speeds to be attained, is rendered inefficient as a result.

It is therefore the object of the invention to provide an expander which exhibits a degressive tension behavior.

The object is achieved according to the invention is achieved by an expander with the features according to claim 1. Additional advantageous embodiments are specified in the subclaims to claim 1. Methods for manufacturing the expander are specified in claims 7 to 10.

According to the invention, a provision is made to construct the expander with an elastic material, the elastic material being a composite material. The composite material has an anisotropic structure. The anisotropy, i.e., the property of having different material properties in different spatial directions, changes during linear expansion. This change in anisotropy is achieved by having the geometric structure of a framework of the composite material change during linear expansion and the orientation of the self-elastic structural elements change relative to the linear expansion. Such a structure has a lattice-type structure, namely in the form of a so-called tiling. A tiling is a closed surface made up of a limited set of distinct geometric items, with the individual items within a set being identical. In the simplest case, there is only a single set of geometric figures, namely squares, which are identical within the set. It is also possible to build a tiling with matching squares and triangles. For small numbers of sets, namely n=1, 2, 3, or 4, tilings that result in a closed surface are only present in small number and with a low number of sides in terms of the geometry of the unit cell. To wit, there are square, i.e., four-fold, unit cells, and there are hexagonal, i.e., six-fold, unit cells of the tiling. Five-fold tilings are also known. However, these are not regular. Furthermore, four-fold tilings include regular and staggered tilings. The tiling consists of tiles that are geometrically identical or congruent within a set.

The elastic composite material of the expander consists of at least two different elastomers. A first elastomer is constructed as a closed line pattern, with the lines representing the boundaries of tiles of a tiling. The pattern is closed, which means that there are no free ends of a line, but each line ends in a point from which more than one other line branches off.

It has proven advantageous if a provision is made that the area ratio of the at least two elastic materials in the composite is approximately the same, with a relative deviation of a material of less than 10% from a uniform distribution. This results in especially pronounced effects in the change in elastic properties during elongation.

In order to intensify the effect of the change in the elastic modulus during elongation, a provision can be made that elastomer granules and/or gas bubbles are present in the other elastic material which have a diameter of between 1 mm and 5 mm and have a surface concentration of less than 20%. The other elastomer is therefore not a foam, but rather an isotropic elastomer with defects that collapse during longitudinal extension, as is the case with gas bubbles, or oppose transverse contraction, as is the case with granules. It is important that distinct phase boundaries form between the elastic regions in the other elastomer.

To prepare such a composite material, it has proven advantageous if a first elastomer is die-cut to form a closed line pattern as the boundary lines of the tiles of a tiling. This first elastomer is then embedded in another elastomer, such as latex or silicone.

In order to intensify the anisotropic effect, a provision can be made that the die-cutting of the first elastomer is stretched, i.e., maintained under tension, during embedding. The change in length during extension should be in the range of 5% and 20%, preferably between 8% and 11%, in order to prevent the formation of ripples or waves in the elastomer caused by the different restoring forces of the individual elements of the composite material.

Figure 2:
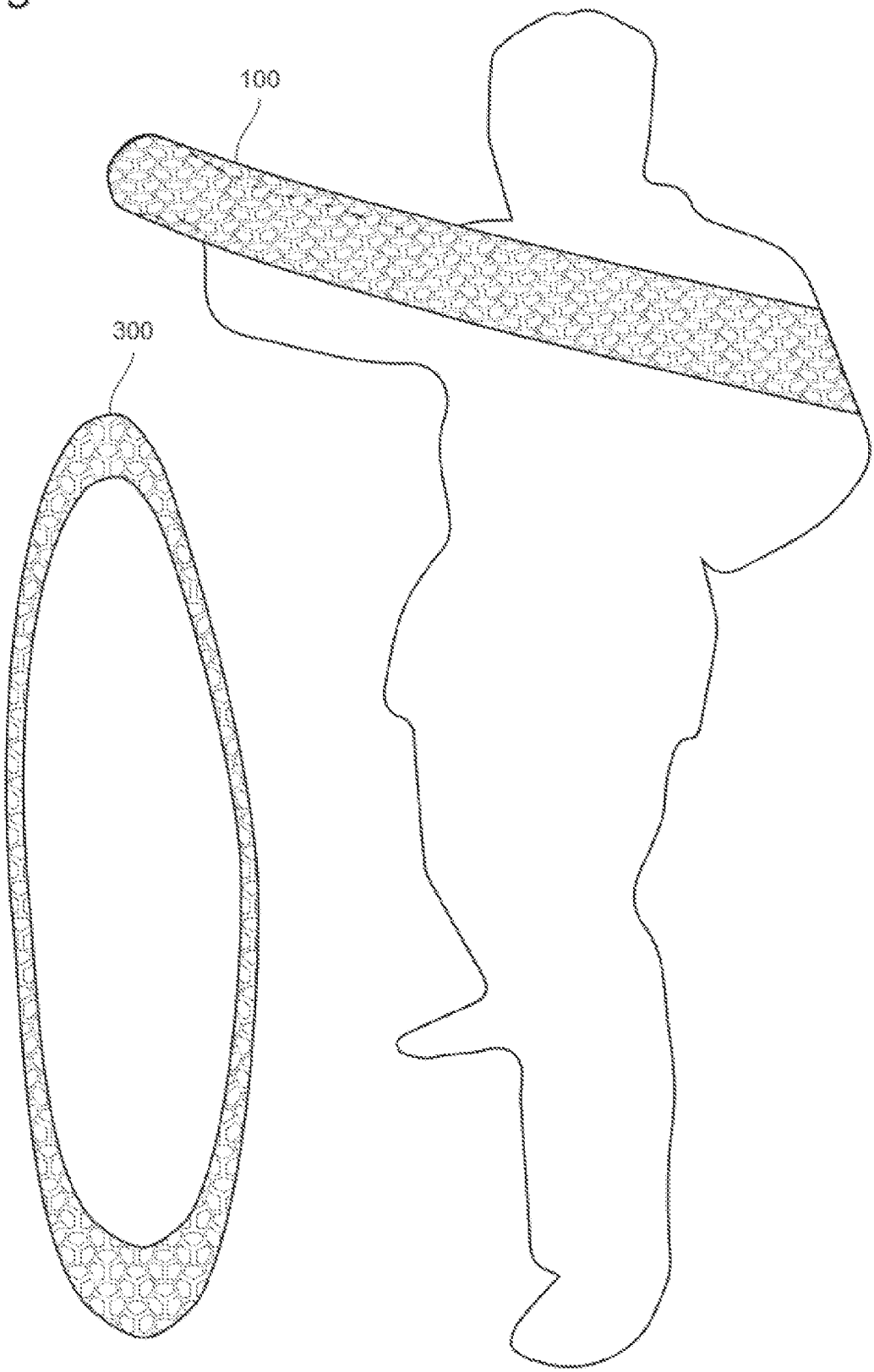
Figure 3:
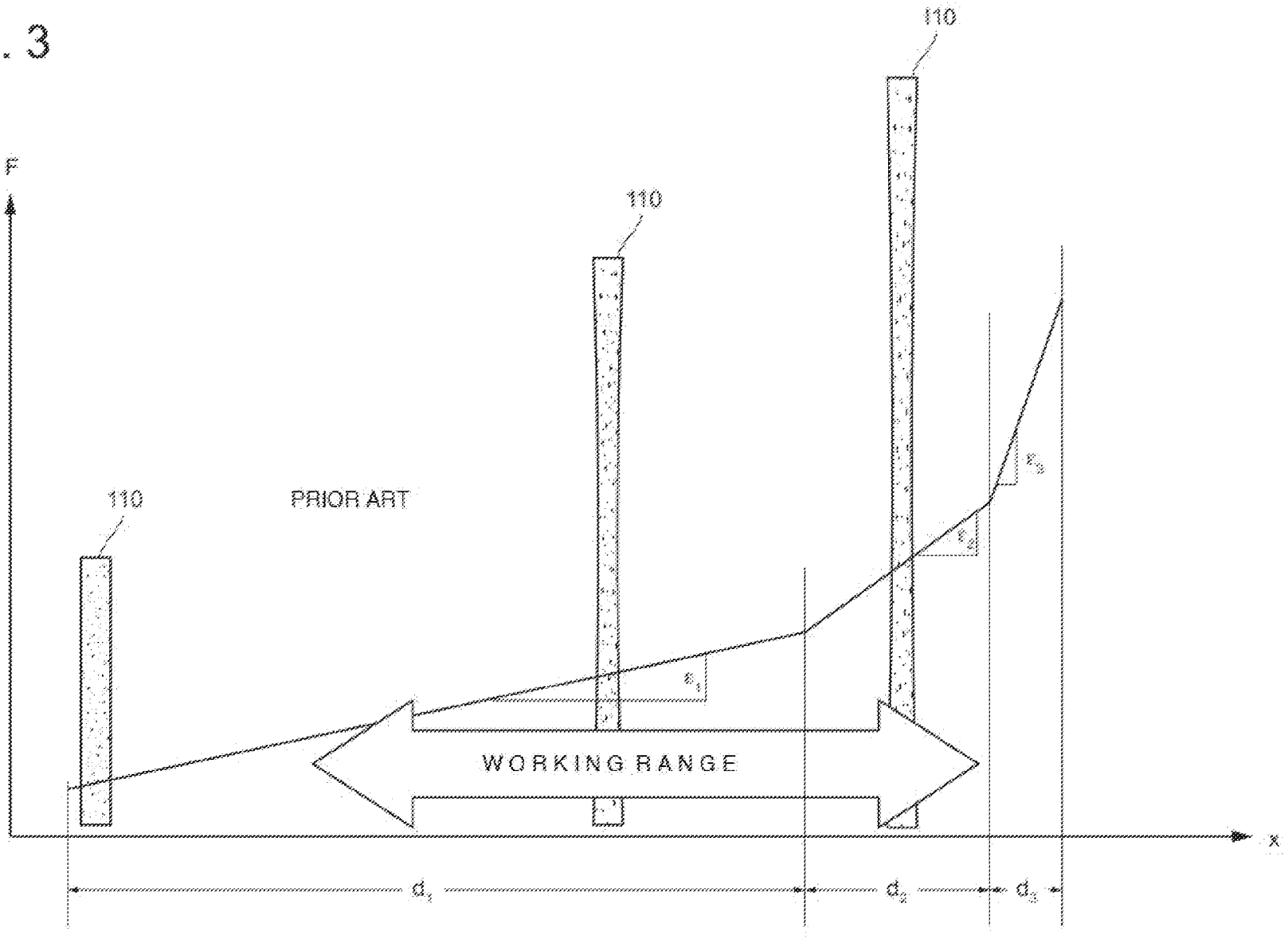

The invention will be explained in further detail with reference to the appended drawing, in which:

FIG. 1 shows a sketch of an expander in the form of an elastic band and a use of the expander during training, FIG. 2 shows a sketch of an expander in the form of a closed loop and a use of the expander during training, FIG. 3 shows a stress-strain diagram of an expander made of an isotropic elastic material from the PRIOR ART.

Figure 4:
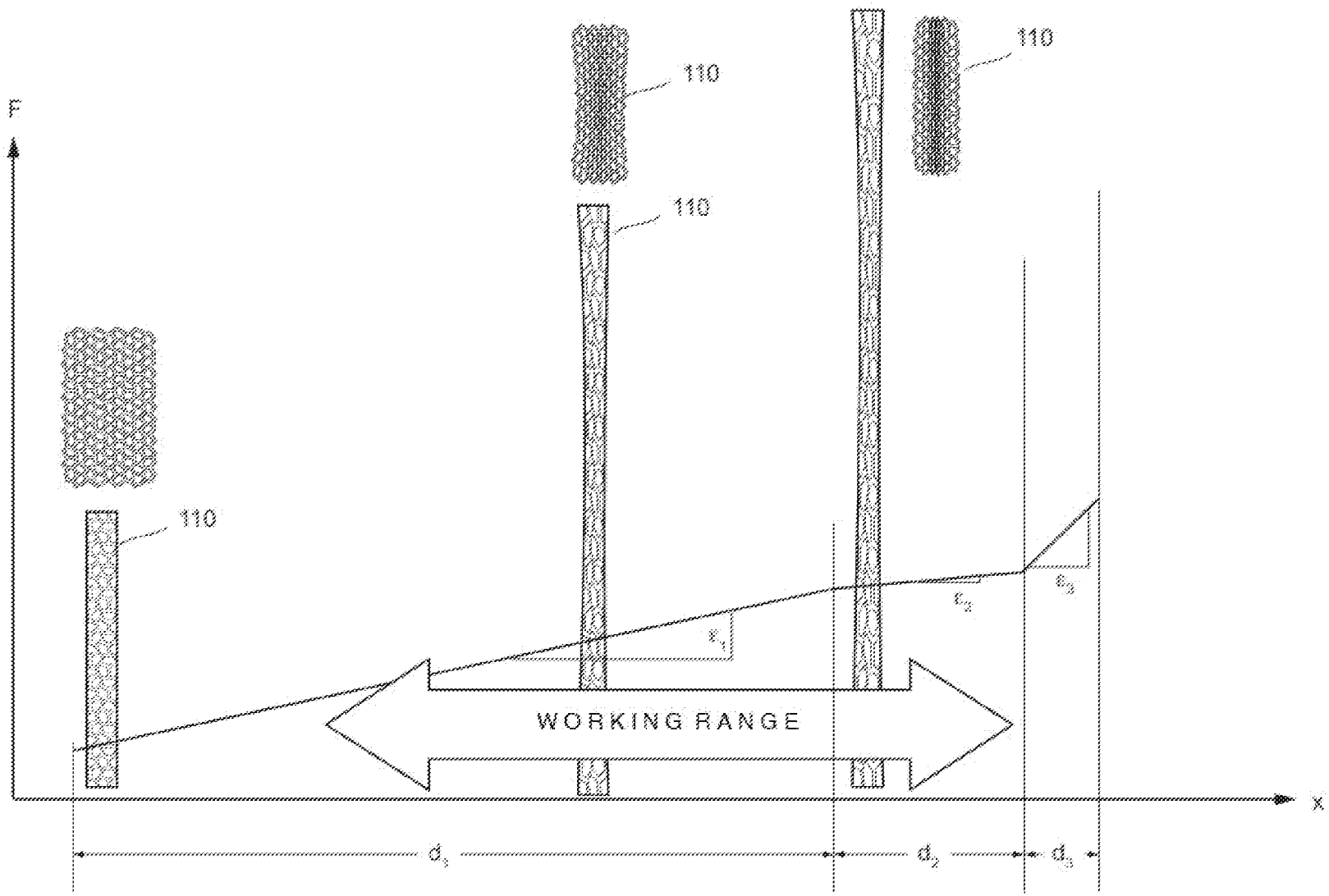
Figure 5:
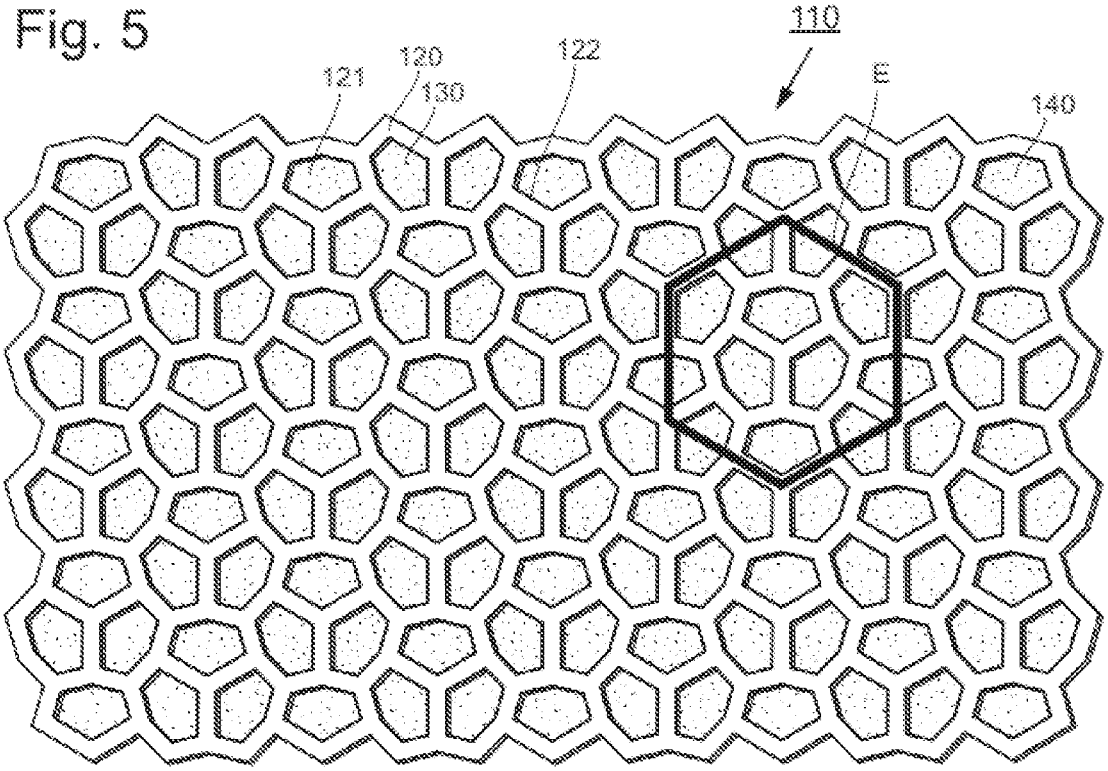
Figure 6:
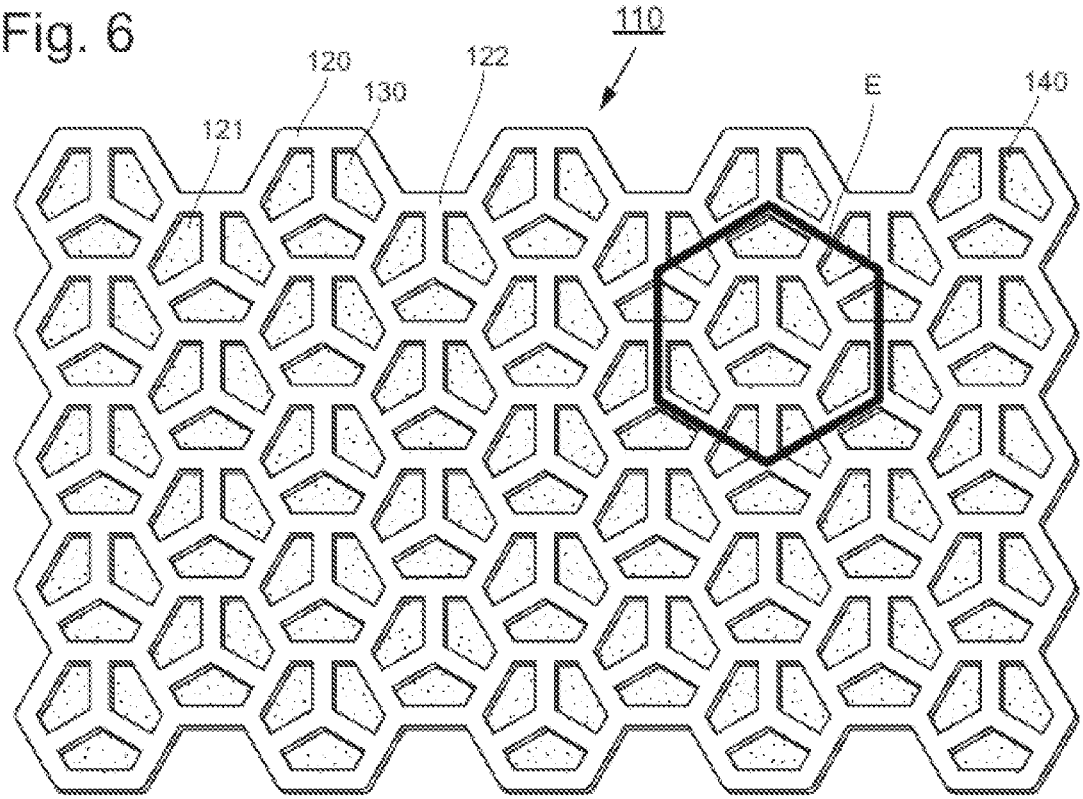
Figure 8:
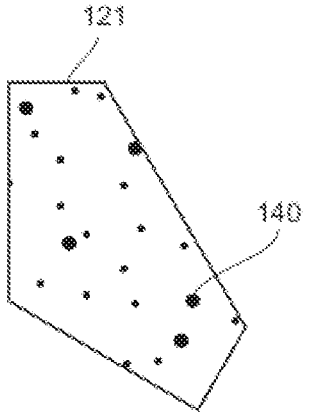
Figure 9:
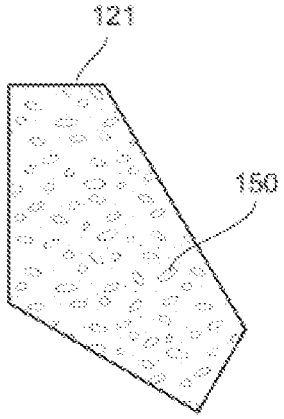
Figure 10:
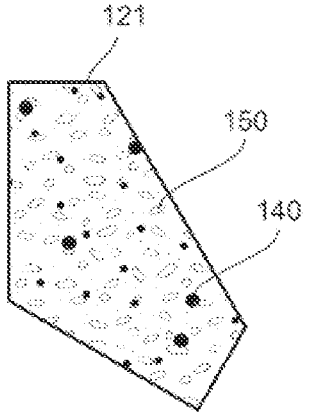

FIG. 4 shows a stress-strain diagram of an expander according to the invention, FIG. 5 shows a first structure of an elastic element with a six-fold unit cell, FIG. 6 shows a second structure of an elastic element with a six-fold unit cell, FIG. 7.1 shows a third structure of an elastic element with a four-fold unit cell, FIG. 7.2 shows the second structure from FIG. 7.1 in stretched form, FIG. 8 shows a section of the composite material of the elastic element with embedded elastomer granules, FIG. 9 shows a section of the composite material of the elastic element with embedded gas bubbles, FIG. 10 shows a section of the composite material of the elastic element with embedded elastomer granules and with embedded gas bubbles.

FIG. 1 shows a schematic drawing of an expander 100 in the form of an elastic band 200 and a use of this expander 100 during training. For training, a band made of an elastic element is placed around the upper body or knotted into a ring, and a boxing movement is performed in the elastic ring created in this manner. This exercise is repeated multiple times in order to strengthen the muscles used. The exercise shown here is merely one of many possible exercises.

FIG. 2 shows a schematic drawing of an expander 100 in the form of a closed ring 300 and a use of the expander 100 during training. For training, the closed ring 300 is placed around the upper body, and a boxing movement is performed in the elastic ring 300. This exercise is repeated multiple times in order to strengthen the muscles used. Here, too, the exercise shown here is merely one of many possible exercises.

FIG. 3 shows a stress-strain diagram of an expander made of an isotropic elastic material from the PRIOR ART. An expander with an isotropic elastic material shown here is usually used in the range of a first extension $d_1$ with a constant elastic modulus 81. In the end range of the elastic extension, further extension $d_2$ follows which has an increased elastic modulus 22 that is associated with a greater restoring force per further extension. The elastic modulus in the end range is no longer constant, but usually increases nonlinearly. The exact characteristic of the elastic modulus $\varepsilon$ in the end range of the elastic range of an elastomer is highly material-specific and differs between rubber-elastic materials (entropy-elastic) and non-rubber-elastic materials.

FIG. 4 shows a stress-strain diagram of an expander according to the invention. What is special about the expander according to the invention is that the elastic modulus $\varepsilon$ decreases in the end range. Even though the restoring force F increases with increasing elongation x, the increase in restoring force F is degressive. This type of stress-strain diagram of an expander is of interest, especially for the purpose of training powerful, fast movements, such as thrusting movements or striking movements. The further increase in the restoring force F decreases in the end range of the expander.

Depending on the geometry of the composite structure, the degression is more or less nonlinear. There are also composite structures in which the elastic composite structure suddenly collapses and one or more kinks can thus be observed in the stress-strain diagram, so that regions with elastic moduli $\varepsilon_1$, $\varepsilon_2$, and $\varepsilon_3$ are formed. The diagram in FIG. 4 shows how the structure of the composite material in the elastic element 110 collapses in a marked working range, which extends over a kink in the elastic modulus $\varepsilon_1$ and $\varepsilon_2$.

FIG. 5 shows a first structure of an elastic element 110 with a six-fold unit cell E. In this case, the elastic element 110 consists of a total of three different materials. A first elastic material is a die-cutting of a first elastic material 120 having a closed line pattern with a six-fold unit cell E, the closed line pattern being instantiated as boundary lines 122 of the tiles 121 of a tiling. In this example, the tiling consists of geometrically identical tiles 121 made of another elastic material, the area ratio of the at least two elastic materials in the composite being approximately the same, with a relative deviation of a material of less than 10% from a uniform distribution. A third material constitutes pieces of a third elastic material that are present in the tiles 121 in the form of coarse elastomer granules 140, which granules have a diameter of between 1 mm and 5 mm and a surface concentration in the tiles of less than 20%.

FIG. 6 shows a second structure of an elastic element with a sixfold unit cell. In this case, the elastic element 110 consists of a total of three different materials. A first elastic material is a die-cutting of a first elastic material 120 having a closed line pattern with a six-fold unit cell E, the closed line pattern being present as boundary lines 122 of the tiles 121 of a tiling. In this example, the tiling consists of geometrically identical tiles 121 made of another elastic material, the area ratio of the at least two elastic materials in the composite being approximately the same, with a relative deviation of a material of less than 10% from a uniform distribution. A third material constitutes pieces of a third elastic material that are present in the tiles 121 in the form of coarse elastomer granules 140, which granules have a diameter of between 1 mm and 5 mm and a surface concentration in the tiles of less than 20%.

FIG. 7.1 shows a schematic drawing of a third structure of an elastic element with a fourfold unit cell. In this case, the elastic element 110 consists of a total of three different materials. A first elastic material is a die-cutting of a first elastic material 120 having a closed line pattern with a four-fold and rectangular unit cell E, the closed line pattern being instantiated as boundary lines 122 of the tiles 121 of a tiling. In this example, the tiling consists of geometrically identical tiles 121 of another elastic material, the area ratio of the at least two elastic materials in the composite being approximately the same, with a relative deviation of a material of less than 10% from a uniform distribution. A third material constitutes pieces of a third elastic material that are present in the tiles 121 in the form of coarse elastomer granules 140, which granules have a diameter of between 1 mm and 5 mm and a surface concentration in the tiles of less than 20%.

FIG. 7.2 shows the second structure from FIG. 7.1 in stretched form. Depending on the direction of extension, the zigzag or triangular line clearly visible in FIG. 7.1 linearizes during the extension. Before the triangular line is stretched, the restoring force is dominated by the overall combination of materials in the elastic element 110. If the structure collapses, the restoring force is almost exclusively dominated by the linearized triangular lines. Due to their small width, they have less to put up against an external force. As a result, the elastic modulus decreases in a degressive manner upon further extension. The restoring force does of course increase with increasing elongation, but to a lesser extent.

FIG. 8 shows a section of the composite material of the elastic element 110 with embedded elastomer granules 140. This illustration shows the elastomeric tiles, i.e., the tiles 121, from the structure in FIG. 6.

FIG. 9 shows a section of the composite material of the elastic element with embedded gas bubbles 150. The elastomer tiles, i.e., the tiles 121, from the structure in FIG. 6 are also shown in this illustration.

Finally, FIG. 10 shows a section of the composite material of the elastic element 110 from FIG. 6 with embedded elastomer granules 140 as well as with embedded gas bubbles 150.

| LIST OF REFERENCE SYMBOLS | |
|---|---|
| 100 | expander |
| 110 | elastic element |
| 120 | elastic material |
| 121 | tile |
| 122 | boundary line |
| 130 | elastic material |
| 140 | elastomer granule |
| 150 | gas bubble |
| 160 | die-cut |
| 200 | elastic band |
| 300 | closed ring |
| ε- | elastic modulus |
| d | elongation |
| E | unit cell |
| F | force |
| x | length |

The invention claimed is:

1. An expander for training muscles, comprising:

an elastic element configured to be expanded against its restoring force for the purpose of training, the elastic element comprising a composite of at least two different elastic materials, wherein a first elastic material is instantiated as a closed line pattern with a staggered or non-staggered four-fold or with a six-fold unit cell, the closed line pattern being instantiated as boundary lines of the tiles of a tiling pattern, and wherein another elastic material fills out the surfaces of the tiles.

2. The expander as set forth in claim 1, wherein the tiling pattern comprises geometrically identical or congruent tiles.

3. The expander as set forth in any one of claim 1 or 2, wherein the area ratio of the at least two elastic materials in the composite is approximately the same, with a relative deviation of a material of less than 10% from a uniform distribution.

4. The expander as set forth in claim 1, wherein the other elastic material contains elastomer granules and/or gas bubbles which have a diameter of between 1 mm and 5 mm and a surface concentration of less than 20%.

5. The expander as set forth in claim 1, wherein the expander is instantiated as an elastic band.

6. The expander as set forth in claim 1, wherein the expander is instantiated as a closed ring.

7. A method for manufacturing the expander as set forth in claim 1, comprising the steps of:

die-cutting a closed line pattern as boundary lines of the tiles of a tiling pattern from a strip of a first elastic material, embedding the previously obtained die-cutting in liquid latex or elastomeric raw material, and curing the liquid latex or elastomeric raw material.

8. The method as set forth in claim 7, further comprising the step of:

extending the die-cutting during the curing of the liquid latex or of the elastomeric raw material by a linear expansion of between 5% and 20%.

9. The method as set forth in claim 7, further comprising the step of:

embedding elastomer granules in the liquid latex or elastomeric raw material, the elastomer granules having a grain size of 1 mm to 5 mm and the surface concentration of the elastomer granules in the liquid latex or elastomeric raw material being less than 20%.

10. The method as set forth in claim 7, further comprising the step of:

foaming of the liquid latex or elastomeric raw material with gas bubbles measuring between 1 mm and 5 mm, the surface concentration of the gas bubbles in the liquid latex or elastomeric raw material being less than 20%.

* * * * *